US011802456B2

(12) United States Patent
Andres et al.

(10) Patent No.: US 11,802,456 B2
(45) Date of Patent: Oct. 31, 2023

(54) GAS-POWERED DOWNHOLE TOOL WITH ANNULAR CHARGE CANNISTER

(71) Applicant: DBK Industries, LLC, Crowley, TX (US)

(72) Inventors: Robert C. Andres, Fort Worth, TX (US); Derrek D. Drury, Fort Worth, TX (US)

(73) Assignee: DBK Industries, LLC, Crowley, TX (US)

( * ) Notice: Subject to any disclaimer, the term of this patent is extended or adjusted under 35 U.S.C. 154(b) by 0 days.

(21) Appl. No.: 17/853,560

(22) Filed: Jun. 29, 2022

(65) Prior Publication Data

US 2023/0003094 A1 Jan. 5, 2023

Related U.S. Application Data

(60) Provisional application No. 63/217,639, filed on Jul. 1, 2021.

(51) Int. Cl.
*E21B 23/06* (2006.01)
*F42C 19/12* (2006.01)
*F42B 3/11* (2006.01)

(52) U.S. Cl.
CPC ..... *E21B 23/065* (2013.01); *F42B 3/11* (2013.01); *F42C 19/12* (2013.01)

(58) Field of Classification Search
CPC .. E21B 23/04; E21B 23/0417; E21B 23/0414; E21B 23/0411; E21B 23/065
See application file for complete search history.

(56) References Cited

U.S. PATENT DOCUMENTS 2,923,204 A * 2/1960 Mohaupt ..... E21B 43/263 175/4.58
3,002,559 A * 10/1961 Hanes ..... E21B 23/065 166/123
3,233,674 A * 2/1966 Leutwyler ..... E21B 23/04 166/66.4
3,266,575 A * 8/1966 Owen ..... E21B 23/065 166/120
4,429,741 A * 2/1984 Hyland ..... E21B 7/061 166/212
4,672,832 A * 6/1987 Merker ..... B21D 39/042 72/62

(Continued)

OTHER PUBLICATIONS https://www.interraenergy.com/rpg; Capture Date: Jul. 11, 2022.

*Primary Examiner* — Kipp C Wallace
(74) *Attorney, Agent, or Firm* — Johnston IP Law, PLLC

(57) ABSTRACT

A downhole tool includes a plurality of mechanical components with some that move relative to others. The tool includes an annular charge cannister associated with the plurality of mechanical components that delivers a gas to move mechanical components. The annular charge cannister includes an annular chamber having a back wall, an interior sidewall, an exterior sidewall, and an open side opposite the back wall. The back wall and the interior sidewall and exterior sidewall form an interior space, and a power charge is disposed within the interior space of the annular chamber. An annular lid is sized and configured to mate with the open side of the annular chamber. The charge cannister may include an ignition port formed in the annular lid for receiving an igniter.

7 Claims, 6 Drawing Sheets

(56) References Cited

U.S. PATENT DOCUMENTS

| | | | | |
|---|---|---|---|---|
| 5,024,270 | A * | 6/1991 | Bostick | E21B 23/065 166/134 |
| 5,211,224 | A * | 5/1993 | Bouldin | E21B 23/04 102/284 |
| 5,316,087 | A * | 5/1994 | Manke | E21B 23/065 166/381 |
| 6,702,009 | B1 | 3/2004 | Drury et al. | |
| 8,887,818 | B1 | 11/2014 | Carr et al. | |
| 8,950,480 | B1 * | 2/2015 | Strickland | E21B 43/116 166/250.01 |
| 9,453,382 | B2 | 9/2016 | Carr et al. | |
| 9,506,316 | B2 | 11/2016 | Carr et al. | |
| 10,107,054 | B2 | 10/2018 | Drury et al. | |
| 10,443,331 | B1 * | 10/2019 | Andres | E21B 23/065 |
| 10,883,327 | B1 | 1/2021 | Drury et al. | |
| 11,326,412 | B2 * | 5/2022 | Arrell, Jr. | E21B 23/065 |
| 2011/0132223 | A1 * | 6/2011 | Streibich | E21B 23/065 102/531 |
| 2014/0034330 | A1 * | 2/2014 | Witt | E21B 33/134 166/373 |
| 2014/0190708 | A1 * | 7/2014 | Hallundbaek | E21B 33/1277 166/207 |
| 2018/0148995 | A1 * | 5/2018 | Burky | E21B 43/117 |
| 2019/0128657 | A1 * | 5/2019 | Harrington | F42D 1/045 |

* cited by examiner

GAS-POWERED DOWNHOLE TOOL WITH ANNULAR CHARGE CANNISTER

RELATED APPLICATION

This application claims the benefit of U.S. Provisional Patent Application No. 63/217,639, filed on Jul. 1, 2021, entitled, "Gas-Powered Downhole Tool with Annular Charge Cannister," the disclosure of which is hereby incorporated by reference for all purposes.

TECHNICAL FIELD

This application is directed, in general, to downhole tools, and more specifically to gas-powered downhole tools having an annular charge cannister.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

Oil and gas provide much of the energy for transportation in the world today. Oil wells are used to bore into the earth and bring petroleum oil hydrocarbons to the surface. In the process of drilling wells, downhole tools are used.

Downhole tools are pieces of oilfield equipment that are used during well drilling, completion and intervention or well workover activities and that help the oil well in optimizing the production levels and maintaining a continuous flow from a reservoir. There are many types of downhole tools that are used to conduct well activities, such as slickline tools and equipment, wireline tools and equipment, drilling jars, fishing tools, pushing tools, drill pipes, tubular tools, centralizers, bridge plugs, packers, cement retainers, frac plugs, dissolving frac plugs, and others. Some tools involve the need to move parts downhole to set the tool in a desired location or for other purposes.

Various downhole tools require moving parts to activate various mechanical functionalities of the particular tool. For example, downhole tools may incorporate switch type devices for turning on or off particular tool functions, release or catch mechanisms to engage or disengage particular tool functions, rotational mechanical parts that activate particular downhole tool functions, and moving parts that change or redirect the flow of downhole fluids such as production fluids, fracking fluids, and drilling fluid which is commonly referred to as mud.

Since downhole tools are located in a well bore at substantial depths, there are limited means to achieve the required mechanical movements because of the technical and spatial limitations within a wellbore. Some typical ways to achieve mechanical movements for activation of downhole tool functionality are the use of hydraulic fluids, rotational motions, pulling motions, and pushing motions. For example, a particular functionality of a downhole tool may be activated by hydraulic pressure of fluids pumped into the well bore through a downhole string or casing. In this case, various mechanisms such as ball seats, which can be used to block the flow of hydraulic fluid, and spring mechanisms, which can be moved by application of sufficient hydraulic pressure, can be used to achieve both lateral and rotational movement of downhole tool components.

Another method to achieve movement of mechanical components of a downhole tool is through physical movement of the downhole tool or of a drill or other downhole string to which the tool is attached. Movements of downhole tool components, and therefore, activation of downhole tool functionality in these cases is achieved by, for example, pushing or pulling on the downhole tool or downhole string or by rotating the downhole tool or downhole string. In these cases, the downhole tool is designed to respond to the corresponding motion to activate a particular function of the downhole tool. Improved tools, systems, and methods are desired.

DESCRIPTION OF THE DRAWINGS

Illustrative embodiments of the present invention are described in detail below with reference to the attached drawing figures, which are incorporated by reference herein and wherein.

DETAILED DESCRIPTION

Figure 1:
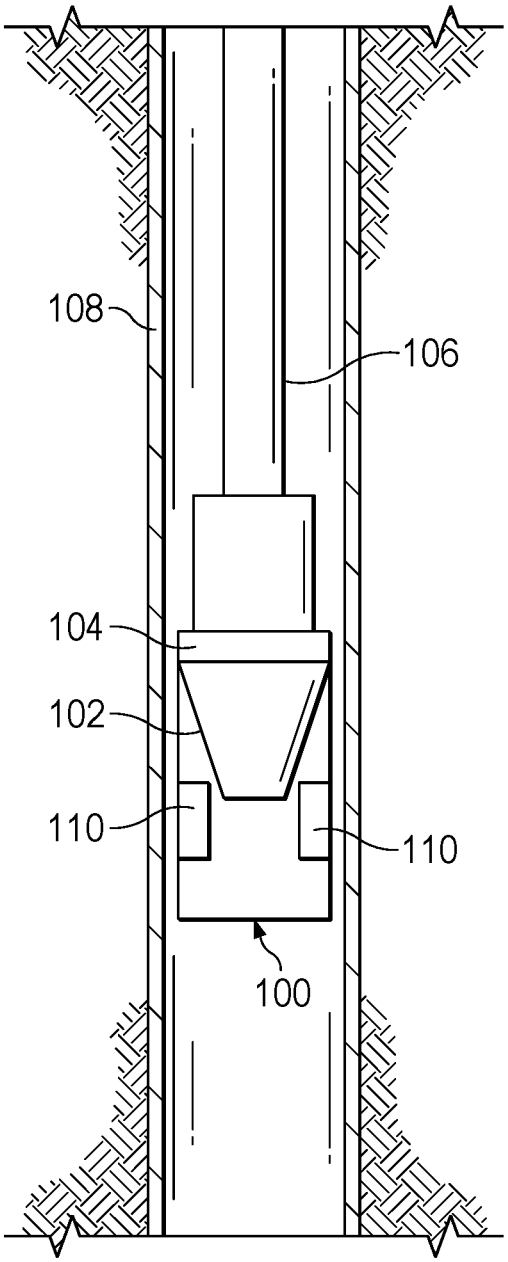
FIG. 1 is a schematic longitudinal cross-sectional view in a well casing of an illustrative embodiment of a downhole tool with functionality activated by a gas generation device and shown in an undeployed position or state.

In the following detailed description of the preferred embodiments, reference is made to the accompanying drawings that form a part hereof, and in which is shown, by way of illustration, specific embodiments in which the disclosure may be practiced. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

Unless otherwise indicated, as used throughout this document, "or" does not require mutual exclusivity.

While the above-described methods for activating various downhole tool functionalities have useful applications in many circumstances, the use of these methodologies may suffer in some regards. For example, if rotational movement of a drill string is used to cause activation of a downhole tool functionality by moving various components of the downhole tool, then often the selective use of another downhole tool or component that uses rotational movement as an activation method is not able to be achieved on the same trip because the rotational movement would activate both downhole tools, which may not be desired. The same is true of tool functionality activation by pushing, pulling, and use of hydraulic fluids. The alternatives to this are the use of more complicated downhole tools, which are more prone to failure, or to make multiple trips into a wellbore so the operator can change the downhole tools between trips, which is costly and time consuming. Again, improvements are desired.

Downhole tools are pieces of oilfield equipment that are used during well drilling, completion and intervention or well workover activities and that help the oil well in optimizing the production levels and maintaining a continuous flow from a reservoir. There are many types of downhole tools that are used to conduct well activities, such as slickline tools and equipment, wireline tools and equipment, drilling jars, fishing tools, pushing tools, drill pipes, tubular tools, centralizers, bridge plugs, packers, cement retainers, frac plugs, dissolving frac plugs, and others. Some tools involve the need to move parts downhole to set the tool in a desired location or for other purposes.

A generated gas may be used to energize the movement of the parts, or components, of the downhole tool. Gas generation may be used with many of the tools mentioned, such as, pipe recovery tools, jet cutters, chemical cutters, mechanical cutters, setting tools, frac plugs, perforating guns, jars, and others. Various embodiments of the disclosure may be used with these tools.

According to one illustrative embodiment, the use of a generated gas can move mechanical components of a downhole tool. In such an embodiment, a gas is generated in a confined or enclosed space, typically through one or more chemical reactions. Since the gas is trapped in a confined or enclosed space, the generation of the gas results in a pressure increase within the confined space. The resulting pressure increase in the confined space then acts as a force against moveable mechanical components of the downhole tool, which results in the movement of such components. This movement can be lateral movement, translational movement, axial movement, or rotational movement. In addition, the movement of the mechanical components of the downhole tool can be a combination of lateral movement, translational movement, axial movement, or rotational movement. The movement of the mechanical components of the downhole tool results in a change in configuration or position of the various components of the downhole tool, which ultimately results in a change of a functionality characteristic of the downhole tool, such as turning on or turning off a particular function of the downhole tool.

According to one illustrative embodiment, gas generation and the resulting pressure from gas generation can be selectively controlled or directed toward the movement of particular components of a downhole tool by the use of vent ports and flow paths designed to direct the flow of gas being generated and therefore selectively applying a pressure force to certain components of the downhole tool.

According to one illustrative embodiment, a gas generation component is a distinct component of a downhole string in which the downhole tool, which is also part of the downhole string, that is the target of the gas generation component is also a component of the downhole string or is otherwise already located within a wellbore. In another embodiment, a gas generation component is an integrated component of a downhole tool. In other embodiments, a downhole string has more than one gas generation device, each of which may be selectively activated.

According to an illustrative embodiment, components that need to be moved downhole may be moved by using a power charge, e.g., flammable solid, to generate pressured gases that are received within a chamber or cylinder or confined space to move a piston or other part relative to other portions or components. The movement of the parts often is used to forcibly set the well tool being run within the well or to achieve the desired movement. In one illustrative embodiment, the power charge is within and part of an annular charge canister. The annular charge cannister has an annular chamber with a mating annular lid and a power charge within the annular chamber.

Figure 2:
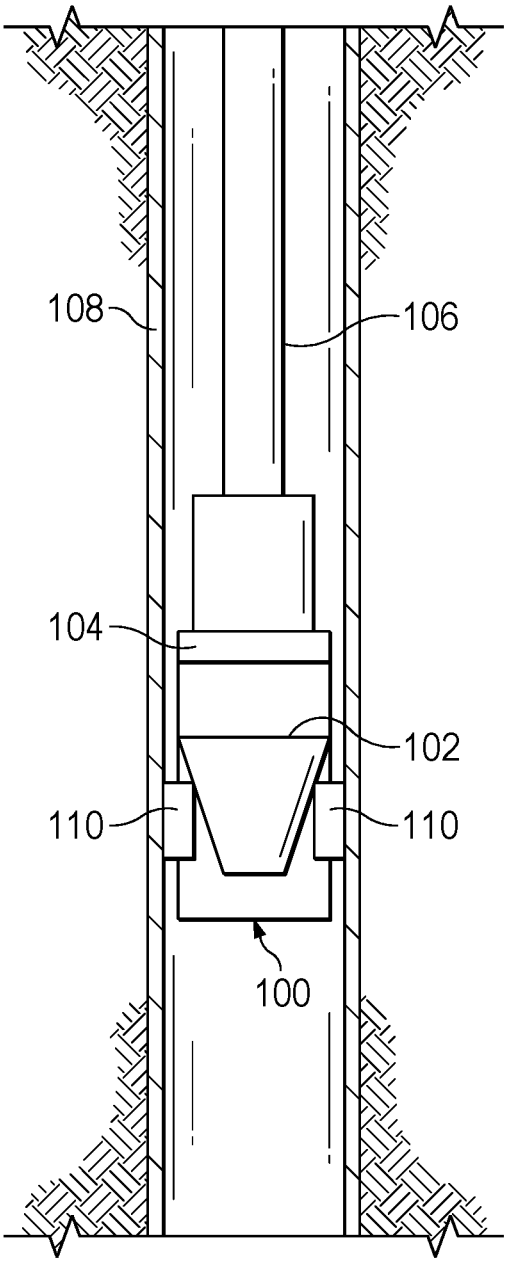
FIG. 2 is a schematic longitudinal cross-sectional view in a well casing of the illustrative embodiment of a downhole tool of FIG. 1 shown in a deployed position or state.

Referring now primarily to FIGS. 1 and 2, for illustration purposes, a simplified downhole tool 100 with a mechanical component 102 that is activated by a gas generator 104 is depicted. FIG. 1 depicts the downhole tool 100 in an inactivated or undeployed state prior to activation of the gas generator 104. FIG. 2 depicts downhole tool 100 in an activated or deployed state after activation of gas generator 104, which include annual cannister has presented further below. The illustrative embodiment of FIGS. 1 and 2 is a generalized embodiment in which the downhole tool 100 may be any type of downhole tool that has a functionality that is controlled through movement of mechanical parts while the tool is downhole. For exemplary purposes, the downhole tool 100 is a simple plug that may be used to stop the flow of fluids within a casing wellbore.

The downhole tool 100 is attached, at an up-hole end, to a string 106 and lowered into a casing 108 to the desired location. The up-hole end of the downhole tool 100 has a smaller diameter than the downhole end of the downhole tool 100. In the embodiment of FIGS. 1 and 2, the gas generator 104 is an integrated component of the downhole tool 100, which is designed to mate with and fit over the smaller diameter up hole end of the downhole tool 100. In this manner the gas generator 104 may form a gas tight seal against a corresponding mating surface of the downhole 100. The gas generator 104 has an internal diameter surface that may be keyed or indexed to a corresponding outer diameter of the downhole tool 100 to ensure proper fit and alignment of the gas generator 104 with the downhole tool 100.

In the illustrative embodiment of FIGS. 1 and 2, the mechanical component 102 is depicted as a simple wedge, which is capable of moving along a central axis of the downhole tool 100 in the downhole direction. It should be understood that the mechanical component 102 of the downhole tool 100 is a gross simplification of the various mechanical components that can be implemented to activate the downhole tool 100 functionality. In many versions of the downhole tool 100, the mechanical component 102 will be a much more complicated component than the simplification depicted in FIGS. 1 and 2. In some embodiments, the mechanical component 102 is a collection of various components that are designed to interact with one another and other components of the downhole tool 100 to achieve the desired functionality of the downhole tool 100. The movement of the mechanical component 102 or the various components making up the mechanical component 102 can utilize any number or types of movement or combinations of types of movements to accomplish the activation of the downhole tool 100 functionality, such as lateral movements, translational movements, and rotational movements.

Once the downhole tool 100 is positioned within the casing 108 at the desired location, the functionality of the downhole tool is activated. Activation occurs by initiation of the gas generator 104. Upon activation of the gas generator 104, a gas is generated within the gas generator 104 and is expelled as directed and this case in the downhole direction. Since the downhole side of the gas generator 104 is mated with an up-hole surface of the downhole tool 100, the generated gas increases the pressure between the gas generator 104 and the mating surface of the downhole tool 100. The mechanical component 102 is designed to respond to the increased pressure between the gas generator 104 and the mating surface of the downhole tool 100. In response to this pressure force, the mechanical component 102, in the simplified embodiment of the downhole tool 100, is forced to move in the downhole direction.

In this embodiment, the mechanical component 102 is cone shaped. As the mechanical component 102 moves in the downhole direction, the sloped walls of the mechanical component 102 contact and engage an inner surface of a sealing element 110. Further downhole movement of the mechanical component 102 causes the sealing element 110 to slide axially within the downhole tool 100. Such movement continues until the sealing element 110 contacts the inner wall of the casing 108, which results in a seal in the wellbore between the casing 108 and the downhole tool 100 to prevent or obstruct fluid flow withing the casing 108 at this point.

The downhole tool 100, in its sealed condition, can be used for any number of purposes in which a well operator would desire to seal flow withing a casing or wellbore. For example, the downhole tool 100 can be used to plug a well permanently, in the case of shutting in a well, or temporarily, such as in the case of introducing fracking fluids into a casing or wellbore. In the case of using the downhole tool 100 for fracking procedures, once the seal between the downhole tool 100 and the casing 108 is formed, fracking fluids are pumped into the casing under pressure. The seal between the downhole tool 100 and the casing 108 creates a positive back force that acts against the fracking fluid, which allows for the operator to generate fluid pressures necessary for fracking the surrounding formation in the area of the casing or wellbore that is up hole of the downhole tool 100.

Once fracking is completed, if flow below the downhole tool 100 is desired, then the downhole tool 100 is removed. Removal of the downhole tool 100 is accomplished by utilizing an activation method to disengage the sealing element 108, milling away the downhole tool 100, dissolving the downhole tool 100, or other well-known methods of removing a downhole tool 100 from a casing or a wellbore. Alternatively, the downhole tool 100 has a controllable flow path allowing for operator control of flow through the downhole tool 100 above and below the downhole tool 100.

While not depicted or described in relation to the embodiments of FIGS. 1 and 2, a person of ordinary skill in the art will appreciate that many additional features and functions of the downhole tool 100 may be present in the downhole tool 100. For example, the downhole tool 100 may include a flow path through the downhole tool 100 to allow for fluid communication through the casing 108 above and below the downhole tool 100. In some embodiments, such a flow path is an always open flow path, and in other embodiments, flow through such a flow path may be controlled by a valve.

In some embodiments of the gas generator 104, there is an annular charge cannister 348 as described in relation to FIGS. 3-11. In some embodiments the gas generator 104 includes vent holes or other openings to direct the flow of gas from the gas generator 104 when the gas generator 104 is activated. In some embodiments the gas generator 104 includes a pressure generation chamber that is initially pressurized by gas released from the gas generator 104 when gas generator is activated. In some embodiments the gas generator 104 is activated by an ignitor, as discussed in relation to FIGS. 3-11. In some embodiments the ignitor is an electronic match.

In some embodiments, a downhole string or a downhole tool may include more than one gas generator 104 in which each gas generator 104 is selectively activatable. In some embodiments multiple gas generators 104 are utilized to activate different downhole tools functionalities.

Figure 3:
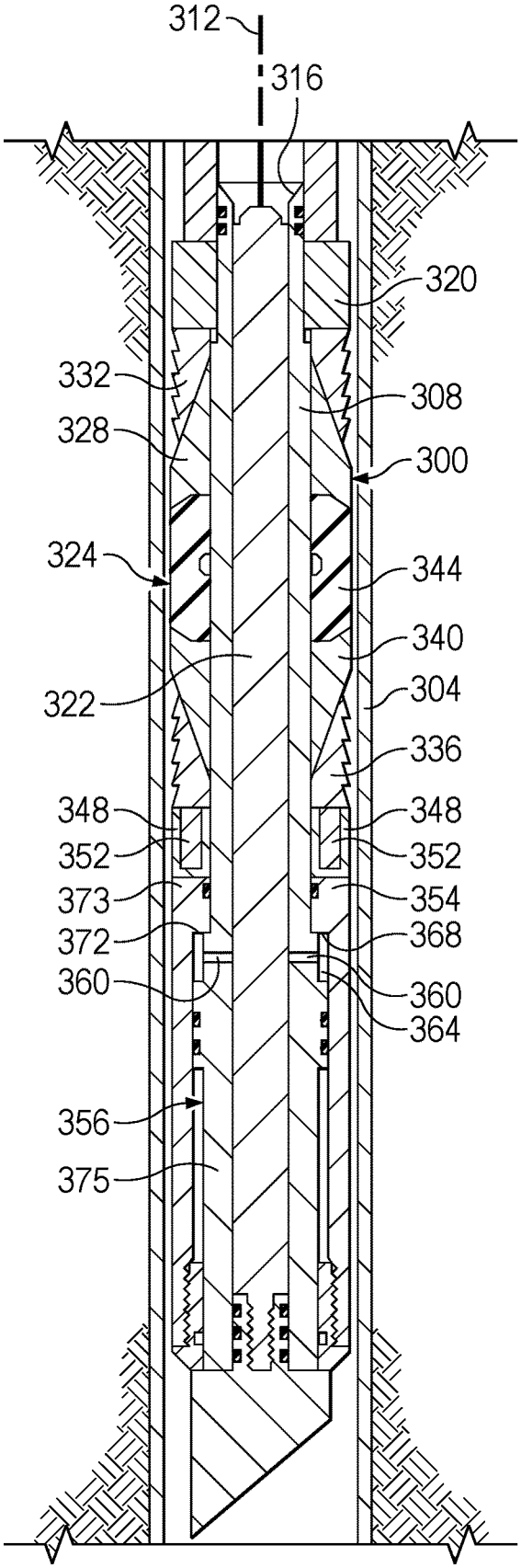
FIG. 3 is a schematic, longitudinal cross section of an illustrative downhole tool in the form of a self-setting frac plug disposed in a run-in condition and located within a well casing.
Figure 4:
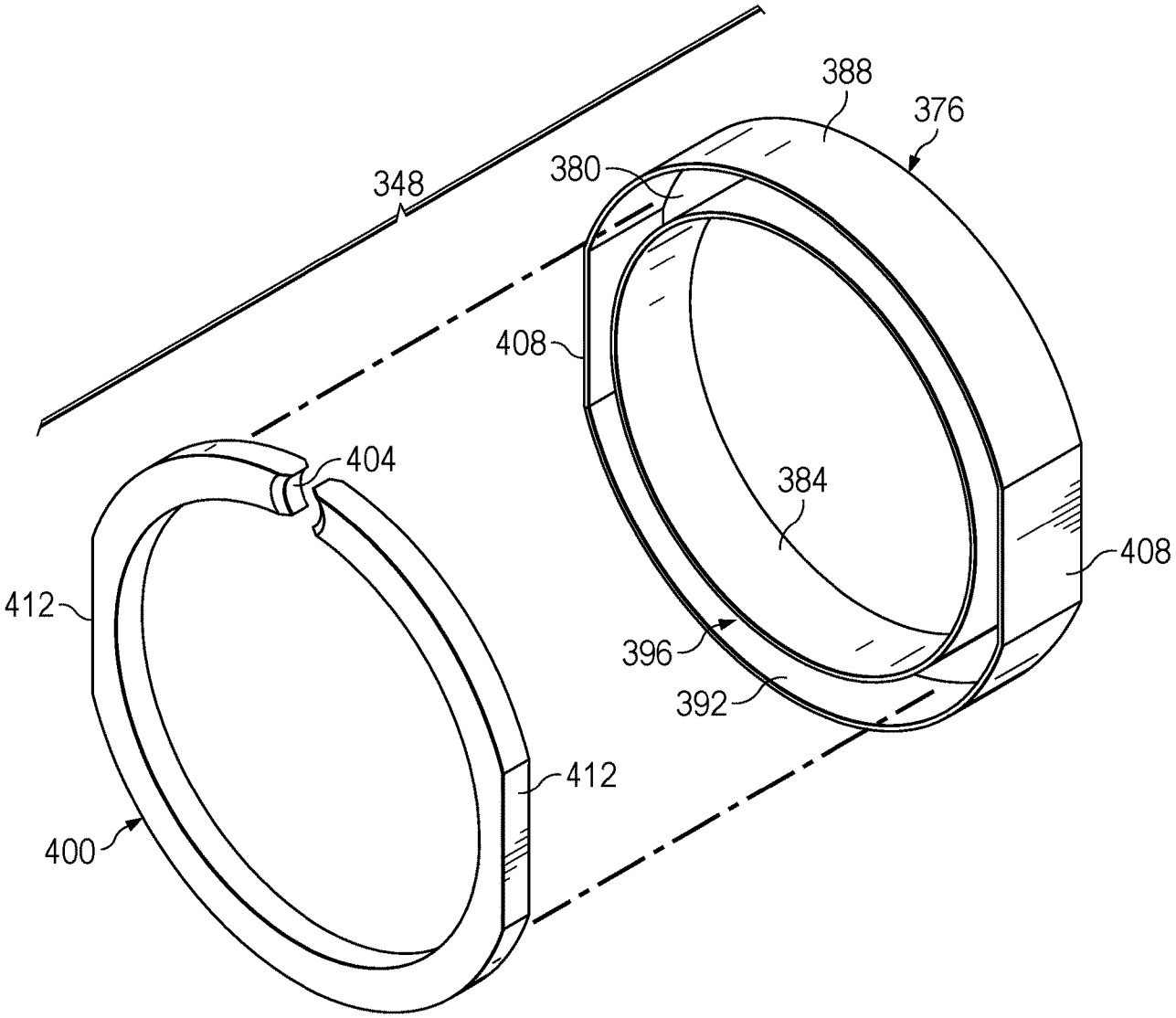
FIG. 4 is a schematic, exploded, perspective view of an illustrative embodiment of an annular charge cannister.

Referring now primarily to FIG. 3, an illustrative embodiment of a self-set full bore frac plug 300 is shown disposed in a run-in condition and located within a well casing 304. The frac plug 300 has a mandrel 308 that provides a central, stationary member for the frac plug 300, extending substantially the full length of the frac plug 300. The mandrel 308 is tubular shaped and may extend concentrically around a central longitudinal axis 312 of the frac plug 300. A ball seat 316 is formed on the upper end of the mandrel 308 for sealingly engaging with a drop ball. The frac plug 300 further includes a lock ring 320 about the setting rod 322 and a seal and anchor assembly 324. The seal and anchor assembly 324 includes an upper conical sleeve 328 and upper slips, which slidably engage with the upper conical sleeve 328 to anchor an upper end of the seal assembly 324 of the frac plug 300 to the well casing 304. The lower slips 336 slidably engage a lower conical sleeve 340 to anchor a lower end of the seal and an anchor assembly 324 of the frac plug 300 to the casing 304. An elastomeric seal element 344 is disposed between the upper conical sleeve 328 and the lower conical sleeve 340 for compressing there-between to seal between an exterior surface of the plug mandrel 308 and the interior surface of the well casing 304.

Below the lower conical sleeves 340 and lower slips 336 is an illustrative embodiment of an annular charge cannister 348 that is filled with a power charge 352. The annular charge cannister 348 is between a lower edge of the lower slips 336 and an upper surface 354 of a barrel piston 356, or piston sleeve.

The power charge 352 is contained within the annular charge cannister 348 of the frac plug 300 and powers the barrel piston 356 to set the slips 336, 328 and expand a seal element 344. The power charge 352 may be a mixture of propellant and epoxy that is cured into solid form in the shape of a chamber or space within the annular charge cannister 348. Power charges are constructed of propellant mixtures composed of carefully controlled combustible elements containing an oxidizer which when ignited will begin a slow burn. The gas derived from a burning power charge propellant mixture gradually builds up to high pressures and causes a setting tool to stroke, setting a downhole tool in a well. The gas from the annular charge cannister 348 may be delivered through one or more ports in the annular charge cannister 348 (or through the lid allowing gases out) through a passageway to the ports 360.

A propellant for the power charge 352 may be provided by a combination of combustible materials and an oxidizer, such as sodium nitrate, Pyrodex, which is a smokeless black powder substitute, and wheat flour. The propellant mixture of the power charge 352 may be formed of a mixture of the propellant and a binder. The binder may be a two-part slow cure epoxy including an epoxy resin and an epoxy hardener which will harden to a solid in twenty-four hours, locking the propellant mixture into the rigid, solid form. To provide the power charge, the propellant mixture may be mixed to a dough-like form, of a consistency similar to cookie dough, which may be tightly packed into a chamber in the annular charge cannister 348 or is packed in uncured form directly into the annular charge cannister 348 in the frac plug 300.

Those skilled in the art will appreciate that many formulations of the power charge 352 may be used in different contexts.

The annular charge cannister 348 or the cannister lid may include a port (404 in FIG. 4) for receiving an igniter. In some embodiments, the igniter may be an electronic match.

The power charge 352 once ignited will burn and generate high pressure gases that pass through the two ports 360 and build pressure within the space 364 located between the barrel piston 356 and the mandrel 308. Force from the pressures of the generated gases will press against an inner end face 368 of the annular-shaped boss 372 of the barrel piston 356, moving the barrel piston 356 upwards to set the frac plug 300. The flow ports 360 extend through the sidewall of the mandrel 308 between the inwardly extending boss 373 and the outwardly extending boss 375. It can be seen that the frac plug 300 includes a plurality of mechanical components associated (coupled by various techniques) with one another for moving within a well casing to accomplish a task downhole and at least one moveable component, e.g., barrel piston 356 associated with plurality of mechanical components that moves relative to at least some of the plurality of mechanical components. The annular charge cannister 348 is associated with the plurality of mechanical components and is concentric with a center of the well casing 304.

The use of an annular charge cannister 348 has been presented in the context of a self-setting frac plug, but it should be understood that the annular charge cannister 348 may be used with any downhole tool requiring gas generation for power including, without limitation, pipe recovery tools, jet cutters, chemical cutters, mechanical cutters, setting tools, frac plugs, perforating guns, jars, darts, and others. With respect to darts, see for example, U.S. Pat. No. 10,100,612, which is incorporated herein by reference for all purposes. In one embodiment, a wireless frac plug that uses counters for activation may also use the cannister to initiate single point or multipoint frac sleeves.

Referring now primarily to FIGS. 4-10, an illustrative embodiment of the annular charge cannister 348 is presented. The annular charge cannister 348 includes an annular chamber 376, or explosives carrier, having a back wall 380, an interior sidewall 384, an exterior sidewall 388, and an open side 392 opposite the back wall 380. The back wall 380, the interior sidewall 384 and the exterior sidewall 388 form an interior space 396, or chamber. A power charge 352 (FIG. 3) is disposed within the interior space 396 of the annular chamber 376 over a majority, e.g., 180 degrees or more, and in some embodiments over the full 360 degrees, of the interior space 396 and may be packed.

An annular lid 400, or plug ring, is sized and configured to mate with the open side 392 of the annular chamber 376 to seal, at least partially, the annular charge cannister 348. An ignition port 404 may be formed in the annular lid 400 for receiving an igniter, e.g., an electronic match or a flame path. In some embodiments, the ignition port 404 is also an exhaust port. The ignition port 404 accepts an electric match or other source of ignition. Once the power charge 352, or ballistic composition, is ignited, the same port 404 may vent gas pressure through the port 404. The annular lid 400 may be coupled to the annular chamber 376 proximate the open side 392 by interference fit, mating screws, fasteners, or epoxy. In some embodiment, the annular lid 400 is not coupled at all. In some embodiments, generated gas may be vented 360 degrees as the annular lid 400 and annular chamber 376 are not hermetically sealed in such embodiments. In some embodiments, there may be a plurality of ignition ports on the lid 400 or annular chamber 376. In some embodiments, there may be a plurality of vent ports on the lid 400 or the annular chamber 376.

In some embodiments, one or more flats 408 may be formed on the exterior sidewall 388 as shown (or interior sidewall 384) that match the flats 412 formed on the annular lid 400 to assist with indexing the annular charge cannister 348 with a downhole tool housing or within the plurality of components that make up the downhole tool.

The annular charge cannister 348, namely the annular lid 400 and annular chamber 376, may be formed from any rigid material that can withstand conditions in the well case. In some embodiments, the annular lid 400 and annular chamber 376 are made from aluminum (e.g., AL 6061-T6), and in other embodiments a dissolvable material or steel.

Figure 6:
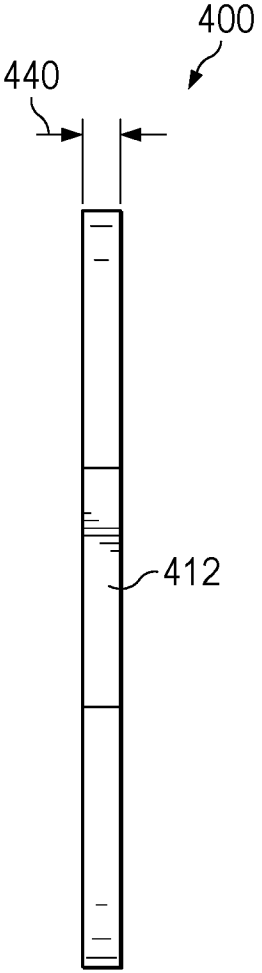
FIG. 6 is a schematic, side elevation view of an illustrative embodiment of the annular lid of FIG. 5.
Figure 5:
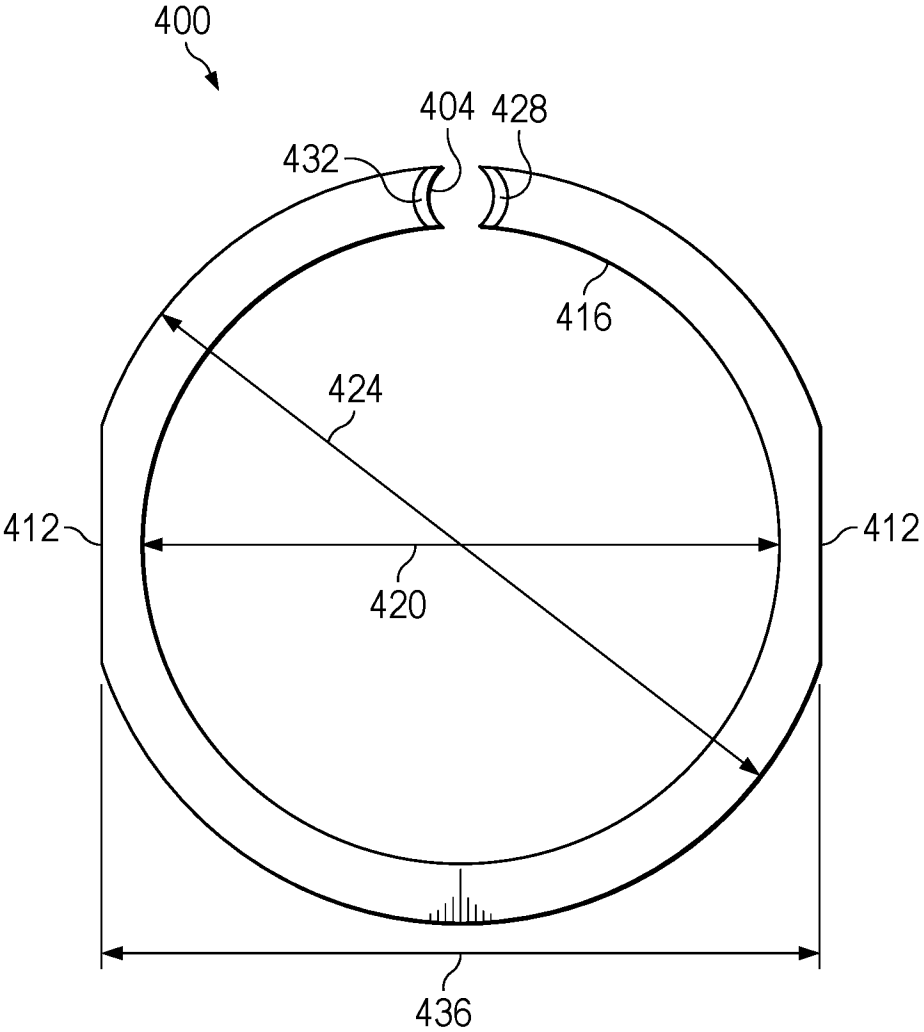
FIG. 5 is a schematic, front elevation view of an illustrative embodiment of an annular lid of an illustrative embodiment of an annular charge cannister.

Referring now primarily to FIGS. 5 and 6, an illustrative embodiment of the annular lid 400 is presented. This embodiment is shown with the flats 412, but it should be understood that other embodiments may be completely circular or annular. In one embodiment, in which the annular charge cannister 348 is sized and configured to go into a dart, the interior opening 416 of the annular lid 400 may have a diameter 420 in the range of 2.0 to 5.0 inches or more, and in one embodiment is 2.44 inches. In the same illustrative dart embodiment, the outside diameter 424 of the annular lid 400 may be 2.0 to 5.0 inches or more and in one embodiment is 2.815 inches. The ignition port 404 may be formed through a portion of the annular lid 400 and in the same dart embodiment may have an aperture 428 of 0.15 to 1.0 inches or more and may have a counter sink 432. In one illustrative dart embodiment, the ignition port 404 has an aperture 428 of 15/64 inches with a 0.33×90° counter sink 232. In the same illustrative dart embodiment, the flats 412 may be included and are separated by a distance 436 in the range of 2.0 to 4.0 inches and in one embodiment by 2.67 inches. The annular lid 400 may have a longitudinal dimension 440 of 0.05 to 0.5 inches or more in the same illustrative dart embodiment.

Figure 8:
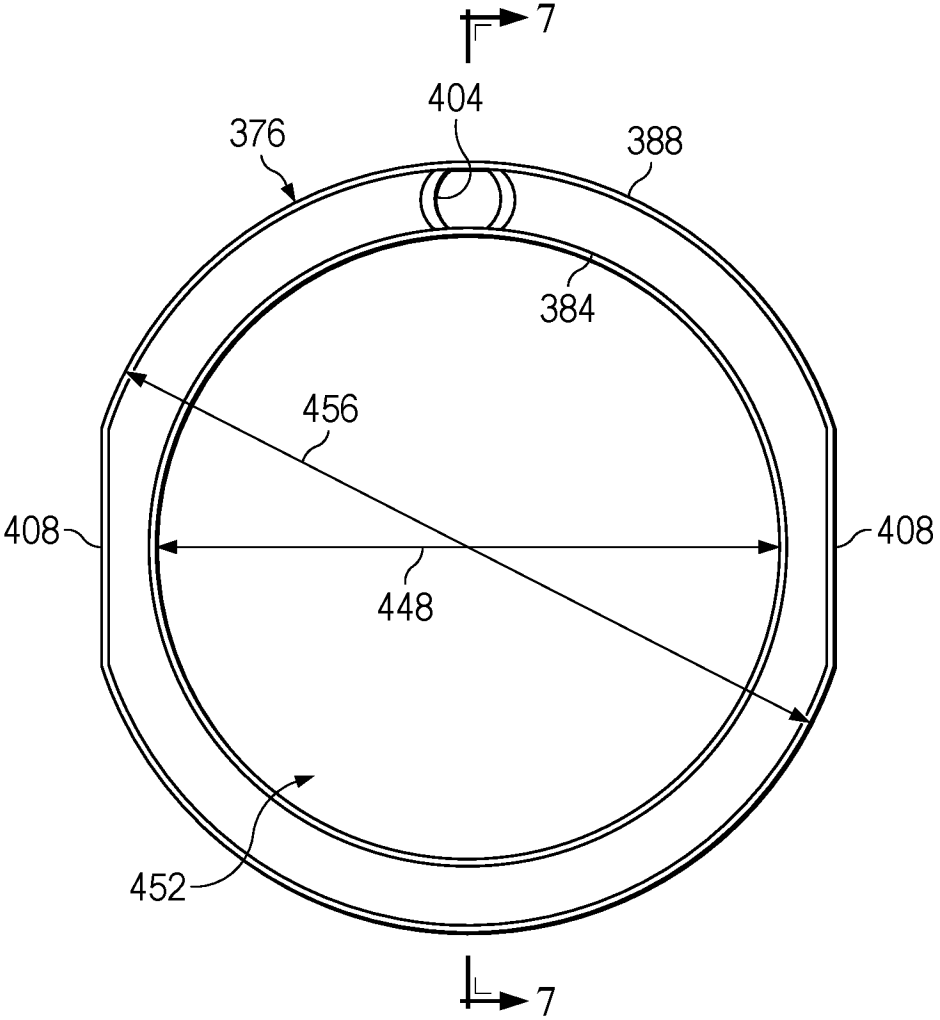
FIG. 8 is a schematic, front elevation view of the illustrative embodiment of an annular chamber of FIG. 7.
Figure 7:
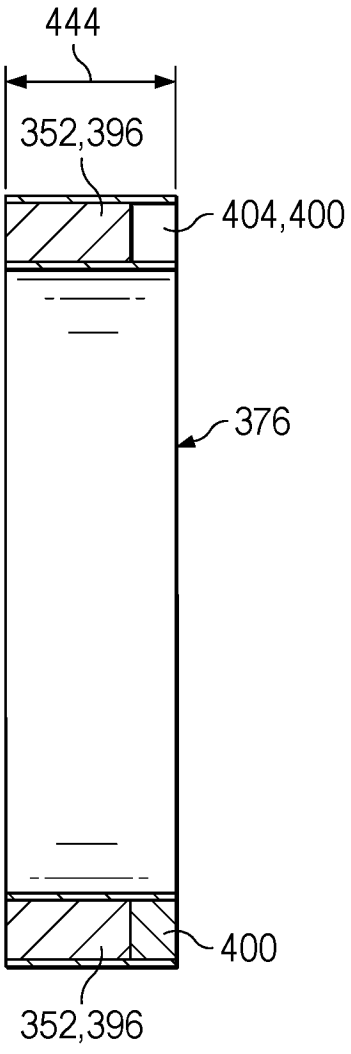
FIG. 7 is a schematic, side elevation view of an illustrative embodiment of an annular chamber of an illustrative embodiment of an annular charge cannister.

Referring now primarily to FIGS. 7 and 8, an illustrative embodiment of the annular chamber 376 is presented. In the cross section of FIG. 7 (taken along lines 7-7 of FIG. 8), one may see the interior space 396 is filled with the power charge 352 and in this embodiment the annular lid 400 fits down into a portion of the interior space 396. In some embodiments for a dart application, such as the one referenced in the previous paragraph, the longitudinal dimension 444 of the annular chamber 376 may be in the range of 0.3 to 2.0 inches or more and in one particular embodiment is 0.596 inches. In the same dart embodiment, the diameter 448 of the interior opening 452 is in the range of 1.75 to 5.0 inches or more and in one particular embodiment is 2.4 inches; the annular chamber 376 may have an outside diameter 456 in the range of 2.0 to 6.0 inches or more and in one particular embodiment is 2.855 inches.

Figure 10:
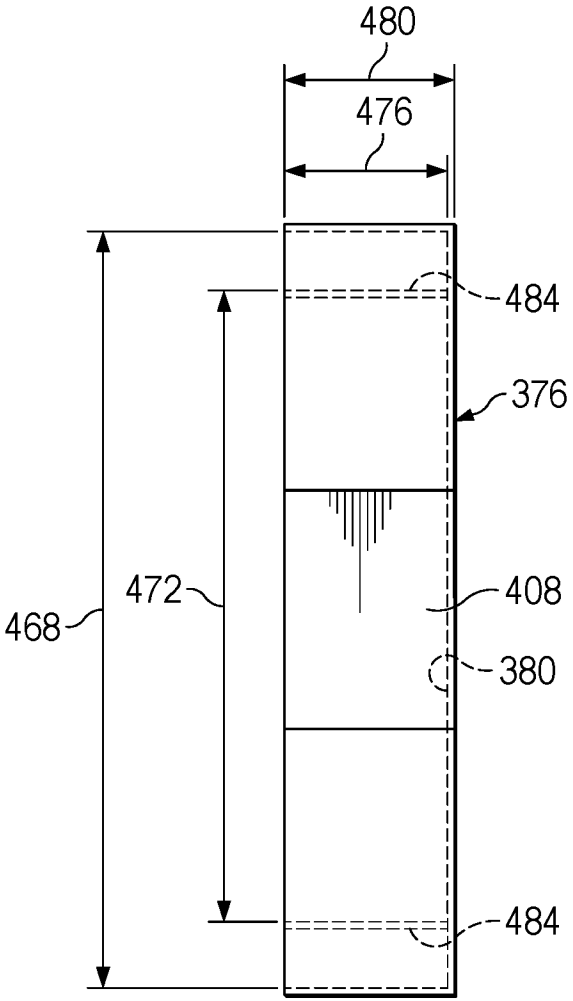
FIG. 10 is a schematic, side elevation view of the illustrative embodiment of an annular chamber of FIG. 7.
Figure 9:
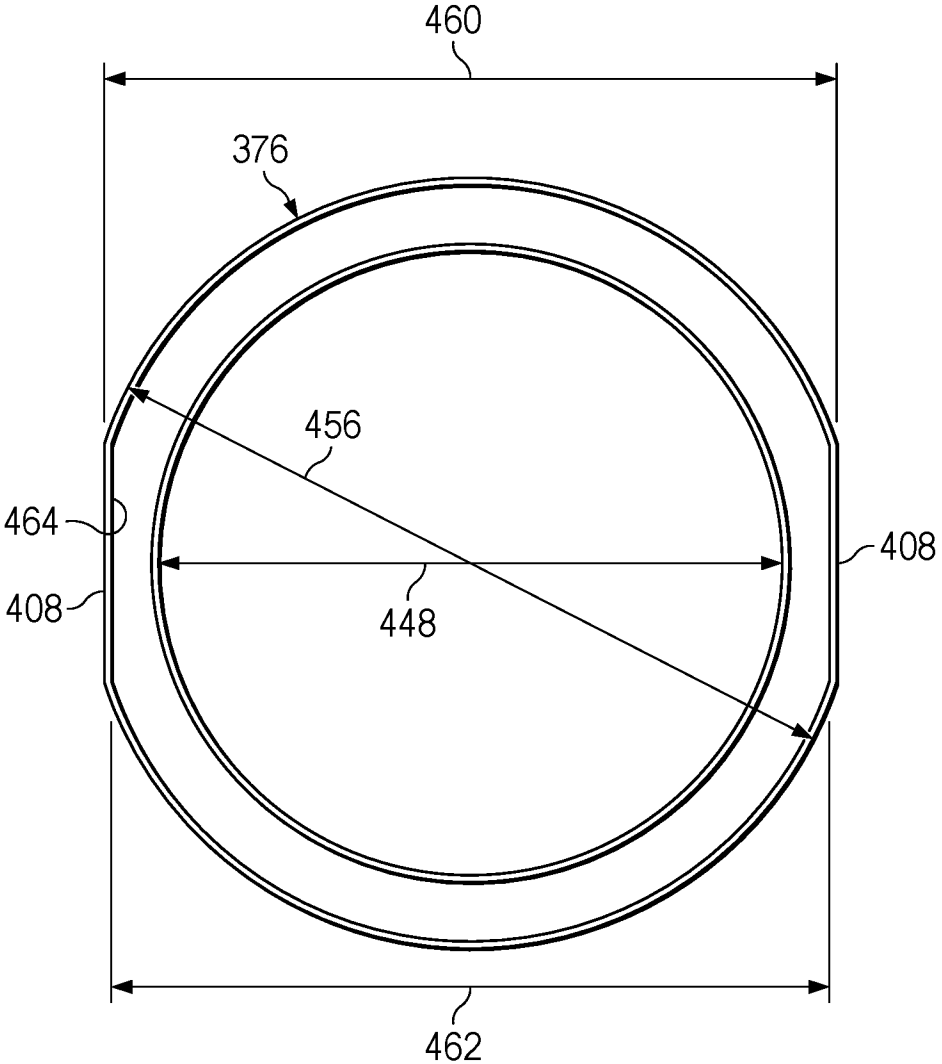
FIG. 9 is a schematic, front elevation view of an illustrative embodiment of an annular chamber of an illustrative embodiment of an annular charge cannister.

As shown well in FIGS. 9 and 10, the exterior of the flats 408 may be spaced by a distance 460 and a distance 462 may be between the interior 464 of the exterior sidewall 388 from flat to flat 408. All the dimensions mentioned herein may be varied according to the application, and in one illustrative dart embodiment, distance 460 is 2.710 inches and distance 462 is 2.670 for a wall thickness of 0.04 inches.

With respect to FIG. 10, dimensions 468, 472, 476, and 480 are shown. Dimension 468 is from the interior 464 of the exterior sidewall to the same location 180 degrees away. Dimension 472 is from an exterior 484 of the interior sidewall 484 to the same location 180 degrees away. Again, the dimensions may vary with application, and in the illustrative dart application, the dimension 468 is 2.815 inches and the dimension 472 is 2.440 inches; the dimension 480 is 0.595 inches and the dimension 476 is 0.565 inches.

Use of an annular charge container 348 may provide certain benefits. Since an annular charge canister 348 is annular in shape, the annular charge canister 348 can be designed to fit around other downhole components such as downhole tools and downhole piping. This may further allow for the annular charge canister 348 to be integrated into a downhole tool as a component of the downhole tool. In addition, the annular feature of an annular charge container 348 allows for fluid flow without obstruction through the annulus of the annular charge canister 348 when the annular charge canister 348 is placed downhole, whether as an individual component of a downhole string or as an integrated component of a downhole tool. Furthermore, the inner or outer surface of the annular charge canister 348 may be keyed or indexed to ensure correct placement and fit of the annular charge canister 348 along a downhole string or with a downhole tool.

Many embodiments may be utilized. In addition to those mentioned above, a number of additional illustrative examples follow.

Example 1. A downhole tool comprising:

a plurality of mechanical components associated with one another for moving within a well casing to accomplish a task downhole;

at least one moveable component associated with plurality of mechanical components that moves relative to at least some of the plurality of mechanical components;

an annular charge cannister associated with the plurality of mechanical components and concentric with a center of the well casing when downhole, the annular charge cannister for delivering a gas to move the at least one moveable component, wherein the annular charge cannister comprises:

an annular chamber having a back wall, an interior sidewall, an exterior sidewall, and an open side opposite the back wall, wherein the back wall and the interior sidewall and exterior sidewall form an interior space, a power charge disposed within the interior space of the annular chamber a majority of the annular chamber, an annular lid sized and configured to mate with the open side of the annular chamber, an ignition port formed in the annular lid for receiving an igniter, and one or more exhaust pathways for allowing gases developed in the interior space to exit the annular charge cannister.

Example 2. The downhole tool of Example 1, wherein the ignition port and one or more exhaust pathways comprise a multipurpose port.

Example 3. The downhole tool of Example 1, wherein the one or more exhaust pathways comprise an exhaust port on the annular chamber.

Example 4. The downhole tool of any of Examples 1-3, wherein the exterior wall of the annular chamber is formed with one or more first flats used for indexing the annular charge cannister with respect to orientation and the annular lid is also formed with one or more second flats that correspond to the one or more first flats.

Example 5. The downhole tool of any of Examples 1-4, wherein the annular lid and the annular charge cannister are coupled with one from the group consisting of: mating threads, magnets, interference fit, and screws.

Example 6. The downhole tool of any of Examples 1-5, wherein the ignition port has a countersink about the ignition port.

Example 7. The downhole tool of any of Examples 1-6, wherein the power charge comprises pyrodex grade P propellant compressed to 1000 psi.

Example 8. The downhole tool of any of Examples 1-7, further comprising an igniter disposed within the ignition port, and wherein the igniter comprises an electric match.

Example 9. The downhole tool of any of Examples 1-8, wherein the annular chamber and annular lid comprise aluminum.

Example 10. An annular charge cannister for use in a downhole tool, the annular charge cannister comprising:

an annular chamber having a back wall, an interior sidewall, an exterior sidewall, and open side opposite the back wall, wherein the back wall and the interior sidewall and exterior sidewall form an interior space, a power charge disposed within the interior space of the annular chamber over a majority of the annular chamber, an annular lid sized and configured to mate with the open side of the annular chamber, an ignition port formed in the annular lid for receiving an igniter, and one or more exhaust pathways for allowing gases developed in the interior space to exit the annular charge cannister.

Example 11. The annular charge cannister of Example 10, wherein the power charge is disposed within the interior space of the annular chamber over 360 degrees of the annular chamber.

Any combination or permutation of these examples or those further above may be used.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. An annular charge cannister for use in a downhole tool, the annular charge cannister comprising:

an annular chamber having a back wall, an interior sidewall, an exterior sidewall, and open side opposite the back wall, wherein the back wall and the interior sidewall and exterior sidewall form an interior space;

a power charge disposed within the interior space of the annular chamber over a majority of the annular chamber;

an annular lid sized and configured to mate with the open side of the annular chamber;

wherein the annular chamber is formed with a through-hole therethrough, and wherein the through-hole is sized and configured to slide over a portion of the downhole tool, wherein the annular charge canister defines an outer diameter of the tool after sliding over the portion;

an ignition port formed in the annular lid for receiving an igniter;

and one or more exhaust pathways for allowing gases developed in the interior space to exit the annular charge cannister.

2. The annular charge cannister of claim 1, wherein the power charge is disposed within the interior space of the annular chamber over 360 degrees of the annular chamber.

3. An annular charge cannister for use with a downhole tool, the annular charge cannister for holding a power charge and comprising:

an annular chamber having a back wall, an interior sidewall, an exterior sidewall, and open side opposite the back wall; wherein the back wall and the interior sidewall and exterior sidewall form an interior space;

a power charge disposed within the interior space of the annular chamber;

an annular lid sized and configured to mate with the open side of the annular chamber;

wherein the annular chamber is formed with a through-hole therethrough, and wherein the through-hole is sized and configured to slide over a portion of the downhole tool, wherein the annular charge canister defines an outer diameter of the tool after sliding over the portion;

an ignition port formed in the annular lid for receiving an igniter; and one or more exhaust pathways for allowing gases developed in the interior space to exit the annular charge cannister.

4. The annular charge cannister of claim 3, further comprising a power charge disposed within the interior space of the annular chamber over a majority of the annular chamber.

5. The annular charge cannister of claim 4, wherein the power charge is disposed within the interior space of the annular chamber over 360 degrees of the annular chamber.

6. The annular charge cannister of claim 3, wherein the one or more exhaust pathways comprises the ignition port.

7. The annular charge cannister of claim 3, further comprising:

a power charge disposed within the interior space of the annular chamber over a majority of the annular chamber;

wherein the power charge is disposed within the interior space of the annular chamber over 360 degrees of the annular chamber; and wherein the one or more exhaust pathways comprises the ignition port.

* * * * *